US011718987B2

(12) United States Patent
Dincel

(10) Patent No.: US 11,718,987 B2
(45) Date of Patent: Aug. 8, 2023

(54) BUILDING ELEMENT

(71) Applicant: Burak Dincel, Erkine Park (AU)

(72) Inventor: Burak Dincel, Erkine Park (AU)

( * ) Notice: Subject to any disclaimer, the term of this patent is extended or adjusted under 35 U.S.C. 154(b) by 42 days.

(21) Appl. No.: 16/332,678

(22) PCT Filed: Mar. 18, 2016

(86) PCT No.: PCT/AU2016/000092
§ 371 (c)(1),
(2) Date: Mar. 12, 2019

(87) PCT Pub. No.: WO2016/172756
PCT Pub. Date: Nov. 3, 2016

(65) Prior Publication Data

US 2021/0363751 A1 Nov. 25, 2021

(30) Foreign Application Priority Data

Apr. 29, 2015 (AU) ..... 2015901518

(51) Int. Cl.
*E04C 3/34* (2006.01)
*E04B 2/86* (2006.01)
*E04B 1/16* (2006.01)

(52) U.S. Cl.
CPC ..... *E04B 2/8629* (2013.01); *E04B 1/165* (2013.01); *E04B 1/167* (2013.01); *E04B 2002/867* (2013.01); *E04C 3/34* (2013.01)

(58) Field of Classification Search
CPC ..... E04B 2/86; E04B 2/8611; E04B 2/8617; E04B 2/8623; E04B 2/8629;
(Continued)

(56) References Cited

U.S. PATENT DOCUMENTS 828,931 A * 8/1906 Cummings ..... E04C 5/0618 52/649.4
1,615,815 A * 1/1927 Birdsey ..... B28B 5/027 156/348
(Continued)

FOREIGN PATENT DOCUMENTS

FR 2 918 399 A1 1/2009
GB 2742068 A 1/2011
(Continued)

OTHER PUBLICATIONS

International Search Report (ISR) dated Jun. 2, 2016 for Application No. PCT/AU2016/000092.
(Continued)

*Primary Examiner* — Kyle J. Walraed-Sullivan
(74) *Attorney, Agent, or Firm* — Armstrong Teasdale

(57) ABSTRACT

An elongated building element (14) having a pair of longitudinally extending generally parallel co-extensive side walls (15) joined by transverse webs (16). The walls (15) and webs (16) enclose a longitudinally extending space (30) within which there is located a tube (31). The tube (31) is connected to the walls (15) and webs (16) by flanges (33). The tube (31) provides a space (33) with the spaces (30, 33) being intended to be filled with concrete. The building element (14) is intended to be attached to light elements (14) to form a wall.

13 Claims, 4 Drawing Sheets

(58) Field of Classification Search
CPC .... E04B 2/8635; E04B 2/8652; E04B 2/8658; E04B 2/8664; E04B 1/167; E04B 1/02; E04B 1/30; E04C 3/34; E04C 5/01; E04C 5/06; E04C 5/0604; E04C 5/0622; E04C 5/0609; E04C 5/0613; E04C 5/0618; E04G 21/12; E04G 21/125
See application file for complete search history.

(56) References Cited

U.S. PATENT DOCUMENTS 2,099,470 A * 11/1937 Coddington ..... E04C 3/293 52/376
2,210,553 A * 8/1940 Miller ..... E04G 21/12 425/111
3,333,386 A * 8/1967 Mora ..... E04C 5/06 52/649.2
3,388,509 A * 6/1968 Mora ..... E04B 1/168 52/2.15
3,440,785 A 4/1969 Denny et al.
3,555,751 A * 1/1971 Thorgusen ..... E02D 29/00 52/127.3
3,562,991 A * 2/1971 Kustusch ..... E04F 13/14 52/564
3,772,842 A * 11/1973 Barbera ..... E04B 2/8652 52/562
3,798,867 A * 3/1974 Starling ..... E04G 23/0225 52/834
3,815,311 A 6/1974 Nisula et al.
3,828,502 A * 8/1974 Carlsson ..... E04B 1/14 52/309.11
3,857,215 A * 12/1974 Moore ..... E06B 1/04 52/259
3,858,374 A * 1/1975 Ben-Zvi ..... E04C 3/34 52/223.8
4,104,837 A 8/1978 Naito
5,274,975 A 1/1994 Haag
5,293,728 A 3/1994 Christopher et al.
5,404,686 A 4/1995 Esposito
5,404,868 A * 4/1995 Sankrithi ..... F24S 30/48 126/604
5,457,929 A * 10/1995 Kim ..... E04C 3/34 52/244
5,706,620 A * 1/1998 De Zen ..... H02G 3/286 52/220.2
5,729,944 A * 3/1998 De Zen ..... E04C 2/22 52/439
5,881,512 A * 3/1999 Chang ..... E04B 2/8629 52/505
5,953,880 A 9/1999 De Zen
5,974,751 A * 11/1999 De Zen ..... E04B 2/8629 52/439
6,123,485 A * 9/2000 Mirmiran ..... E02D 31/02 405/232
6,189,269 B1 * 2/2001 De Zen ..... E04B 1/14 52/220.1
6,212,845 B1 * 4/2001 De Zen ..... E04B 2/8629 52/607
6,219,986 B1 * 4/2001 Ouchi ..... E04G 23/0218 52/425
6,247,280 B1 * 6/2001 Grinshpun ..... E04B 2/8635 52/309.12
6,643,982 B1 * 11/2003 Lapp, Jr. ..... E04C 3/36 52/127.2
8,484,915 B1 * 7/2013 Abbas ..... E04C 3/34 52/223.4
9,856,647 B1 * 1/2018 Kim ..... E04B 1/943
10,208,493 B1 * 2/2019 Sim ..... E04C 3/34
11,142,911 B2 * 10/2021 Chen ..... E04C 3/34
2004/0244321 A1 * 12/2004 Dincel ..... E04B 2/8629 52/503
2005/0050837 A1 * 3/2005 Wang ..... E04C 5/0604 52/600
2005/0055922 A1 * 3/2005 Shamsai ..... E04C 5/06 52/319
2005/0223673 A1 * 10/2005 Cadwell ..... E04H 12/02 52/834
2006/0005497 A1 * 1/2006 Foell ..... E04B 2/8629 52/589.1
2006/0272265 A1 * 12/2006 Pryor ..... E04C 3/005 52/645
2007/0044405 A1 * 3/2007 Straub ..... E04B 2/8629 52/309.11
2007/0278380 A1 * 12/2007 Marker ..... E04C 3/34 249/189
2008/0222976 A1 * 9/2008 Liskey ..... E02D 27/42 52/169.9
2009/0120025 A1 * 5/2009 Sezen ..... E04C 5/0604 52/340
2009/0282753 A1 * 11/2009 Kuan ..... E04C 5/0609 52/167.1
2013/0133278 A1 * 5/2013 Kim ..... E04C 3/34 52/223.4
2014/0013695 A1 * 1/2014 Wolynski ..... E04C 2/3405 52/426
2014/0106108 A1 * 4/2014 Lin ..... A63H 33/082 428/58
2015/0040497 A1 * 2/2015 Lessard ..... E04B 1/30 52/233
2018/0135299 A1 * 5/2018 Taleb ..... E04B 2/8652
2019/0136568 A1 * 5/2019 Karakas ..... E04C 5/0622
2020/0392732 A1 * 12/2020 Chen ..... E04B 1/58
2021/0047825 A1 * 2/2021 Mou ..... E04H 9/024
2021/0301530 A1 * 9/2021 Faridnia ..... E04C 5/163

FOREIGN PATENT DOCUMENTS

JP 2004-190475 A 7/2004
JP 4191785 B1 12/2008
JP 2009-221696 A 1/2009
WO 2012/139153 A1 10/2012
WO WO-2014044644 A1 * 3/2014 ..... E04B 2/8635

OTHER PUBLICATIONS

Written Opinion (WO) dated Jun. 2, 2016 for Application No. PCT/AU2016/000092.
Written Opinion (WO) dated Oct. 10, 2018 for Singapore Application No. 11201708708X.
Espacenet English abstract of JP 2004-190475 A.
Espacenet English abstract of JP 4191785 B1.
Espacenet English abstract of FR 2 918 399 A1.
English translation of FR 2 918 399 A1.

* cited by examiner

10

40
14
22
22
14
19
33
34
18
18
18
38
31
21
22
19
31
18
14
18
14
38

14
32
23
23
16
20
20
19
19
30
34
34
15
15
33
33
21
21
16
22
22
31

21
22
22
21
16

31
34
14
33
32
30
15
40
31
15
32
33
34
37
10
19
19
16
23
20
23
20
14
15
15
19
19
15
15
16
16
15
16

15
14
40

BUILDING ELEMENT

RELATED APPLICATION

This application is an application under 35 U.S.C. 371 of International Application No. PCT/AU2016/000092 filed on Mar. 18, 2016, the entire contents of which are incorporated herein by reference.

FIELD

The present invention relates to building elements and more particularly but not exclusively to building elements which are joined to form walls and columns of a building.

BACKGROUND

It is known to form walls from building elements which are vertically extended extruded hollow members. Adjacent members are connected by cooperating flanges and grooves. The elements are hollow and are subsequently filled with concrete to provide them with strength and rigidity. Typically, the building elements are formed of extruded plastics/polymer material. Reinforcing steel is often inserted in the elements prior to the concrete being delivered to the elements.

U.S. Pat. No. 6,212,845 discloses a building element in which the elements are joined by longitudinal sliding relative movement. A wall is constructed by connecting adjacent elements by first connecting one element to a floor and then coupling subsequent elements thereto by vertically sliding relative motion. A similar construction is also disclosed in U.S. Pat. Nos. 6,189,269, 5,974,751, 5,953,880, 5,729,944 and 5,706,620.

Described in U.S. Pat. No. 7,763,248 and International Patent Application PCT/AU2012/000358 is a building element in which the adjacent members are not connected by longitudinal sliding movement, but are connected by transverse relative movement between the elements. In particular the elements snap engage.

Less relevant structures are described in U.S. Pat. Nos. 3,440,785, 3,555,751, 3,815,311, 3,828,502, 4,104,837, 5,274,975, 5,293,728, 5,404,686 and 6,247,280.

An issue with the above described building elements is that they have transverse webs, and may include reinforcing, with the webs and reinforcing inhibiting flow of concrete through the element.

The previous building elements with only transverse webs are susceptible to damages at the transverse webs due to improper handling during transportation, site delivery/cranage and even horizontal steel reinforcement placement. The failure of the building element upon receipt of concrete will be unavoidable if the transverse webs are damaged. The failure will be further exacerbated particularly if the web holes between panel joints do not coincide with each other which will prevent the flow of concrete. The transverse webs also clash with vertical starter bars. Failure can also result from inappropriate use of concrete vibrators, and pouring the concrete from an excessive height. The vibrators and excessive height can result in excessive hydrostatic pressure that can damage the building elements to the extent that they fail.

To fill the elements with concrete, the concrete needs to be able to flow reasonably easily in order to minimise voids in concrete fill that can adversely affect the strength of the structure. Accordingly the concrete preferably has a raised slump value, which exacerbates the above problems with excessive hydrostatic pressure.

A disadvantage of the above described building elements is that if concrete having a high slump value is employed, considerable pressure is placed on the building elements, particularly at their lower portions where the hydrostatic pressure is the greatest, which can cause distortion and/or failure of the building element. The previously described building elements, even with low slump concrete, require concrete infill placement at maximum 1.5 metre intervals to minimise the potential distortion and/or failure of the plurality of building elements.

High slump concrete use is preferred in building elements particularly where waterproofing is required to eliminate conventionally applied waterproof membranes. The cement slurry with increased viscosity ensures that the building element panel joints are filled which makes the snap-connecting joint waterproof as described in International application PCT/AU2012/000358. High slump is also preferred is the building element to facilitate flow of the concrete through holes in the element The waterproof panel joints, other than elimination of conventionally applied membranes, are required to eliminate the potential corrosion of horizontal reinforcing steel bars conventionally used in concrete walls. The protection of horizontal reinforcing steel bars necessitates that the panel joints in building elements are required to be waterproof. Otherwise each panel joint will act as a natural crack path to carry external contaminants to horizontal reinforcing steel bars which will result in unavoidable corrosion of horizontal reinforcing steel bars for conditions such as below ground and façade walls subject to sea breeze or high moisture ambient conditions.

OBJECT

It is the object of the present invention to overcome or substantially ameliorate at least one of the above disadvantages.

SUMMARY OF INVENTION

There is disclosed herein a hollow elongated building element into which concrete is to be poured, the element including:

a pair of longitudinally extending spaced side walls which are generally parallel;

spaced transverse webs joining the side walls surrounding a longitudinally extending space; and at least one longitudinally extending tube located in the space and connected to the walls and/or webs by a plurality of connecting flanges.

Preferably, the walls are generally co-extensive and generally parallel.

Preferably, the connecting flanges connect the tube to the walls and webs.

Preferably, the webs are provided with apertures through which the concrete can pass.

Preferably, the tube has apertures through which the concrete can pass.

Preferably, each tube is of a circular transverse cross-section.

Preferably, there is only one tube.

Preferably, said tube is a first tube, and said element includes a second longitudinally extending tube, the second tube also being located in said space, and being displaced from the first tube.

Preferably, the element further includes flanges joining the first and second tube.

Preferably, each side wall has a longitudinally extending groove and a longitudinally extending joining flange extending from the side wall, with each flange and groove being positioned and configured to engage a respective groove or flange of a like element to secure adjacent elements together by engagement of the flange within its respective adjacent groove by movement of the groove and flange relative to each other, with each groove being formed in a respective one of the side walls and each flange extending from a respective side wall so that the like element is located between the flanges to provide for engagement of the flanges and groove, and the side walls and webs surround a longitudinally extending space that receives the concrete, and the element further includes at least one of the grooves and its respective flange snap engage to connect the adjacent elements.

Preferably, the movement is generally transverse of the element.

In an alternative embodiment, the movement is longitudinal sliding relative movement between the element and like element.

Preferably, the element is of a unitary construction.

Preferably, the element is an extrusion.

Preferably, the element is an assembly.

BRIEF DESCRIPTION OF DRAWINGS

Preferred forms of the present invention will now be described by way of example with reference to the accompanying drawings wherein.

DESCRIPTION OF EMBODIMENTS

Figure 1:
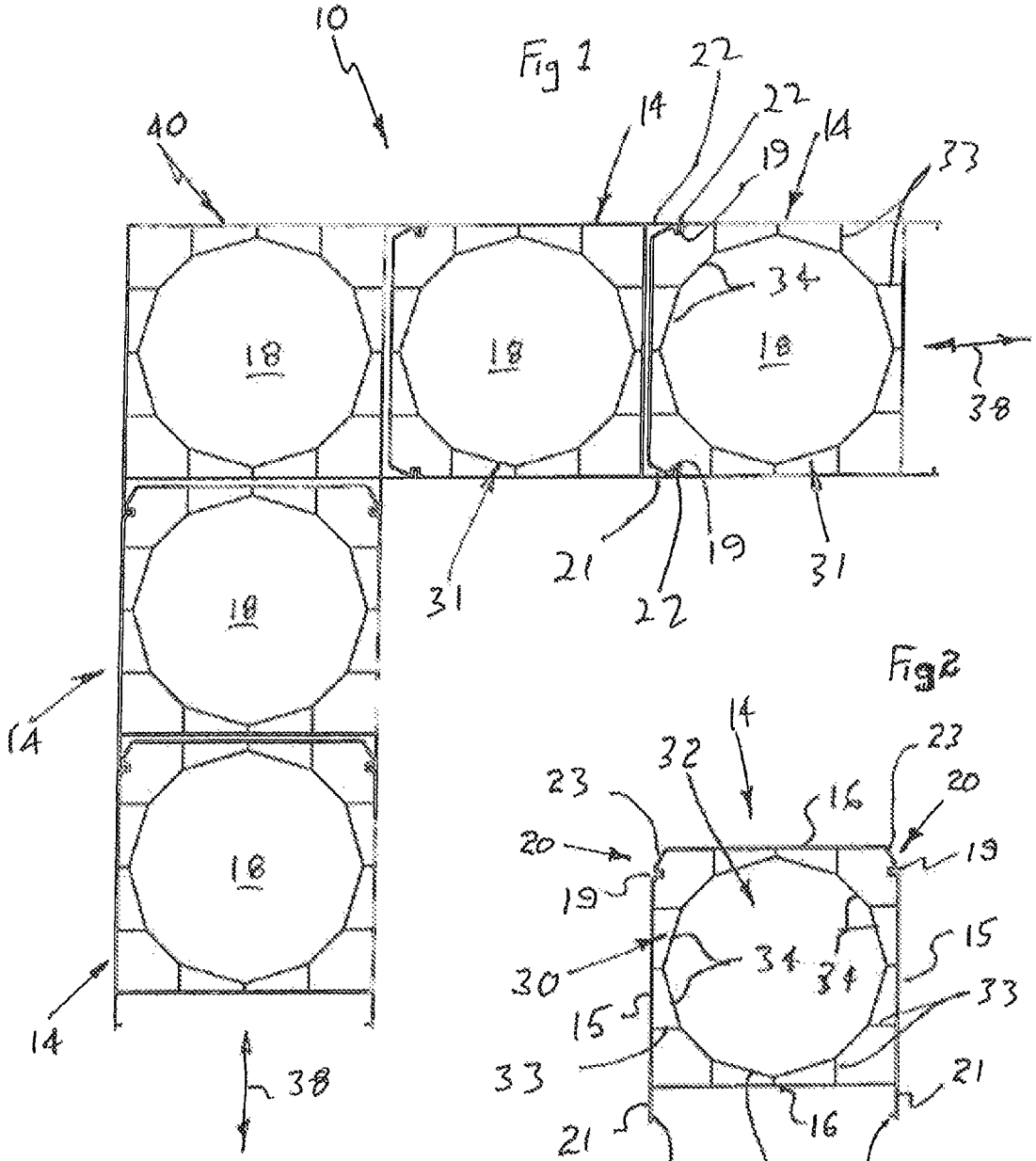
FIG. 1 is a schematic top plan view of a plurality of building elements forming portion of a wall.

In the accompanying drawings there is schematically depicted portion 10 of a wall. The portion 10 is formed of a plurality of building elements 14. Each of the elements 14 is longitudinally elongated and is intended to receive concrete. The elements 14 may be of a unitary construction. In an alternative preferred form each of the elements 14 may be constructed by connecting adjacent parts together. A corner element 40 joins rows of elements 14. The elements 14 can be referred to as "formwork", including "permanent formwork".

The element 14 has two generally parallel coextensive side walls 15 joined by transverse webs 16. Typically, the webs 16 would have apertures 17. Accordingly, the elements 14 provide a permanent formwork to receive the concrete 18. Typically, high slump concrete is poured into the assembled elements 14. Preferably, the elements 14 would be formed of extruded plastics material, such as polyvinyl chloride, so as to provide a permanent waterproof finish, and so as to be of a unitary construction.

Figure 2:
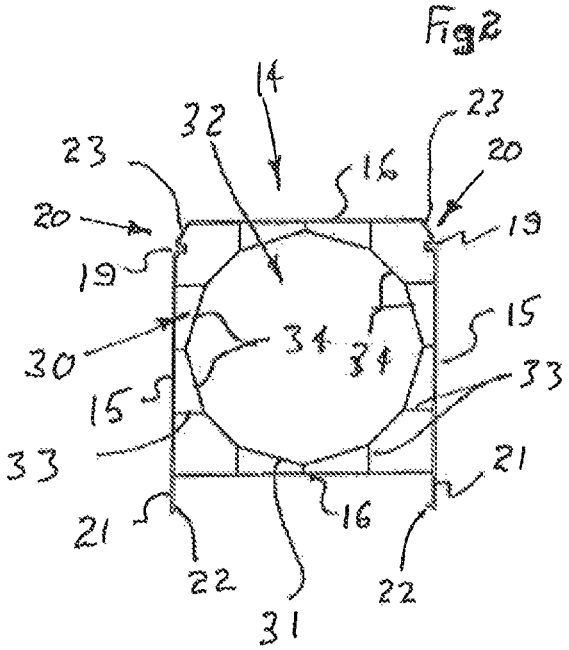
FIG. 2 is a schematic top plan view of one of the elements of FIG. 1.
Figure 3:
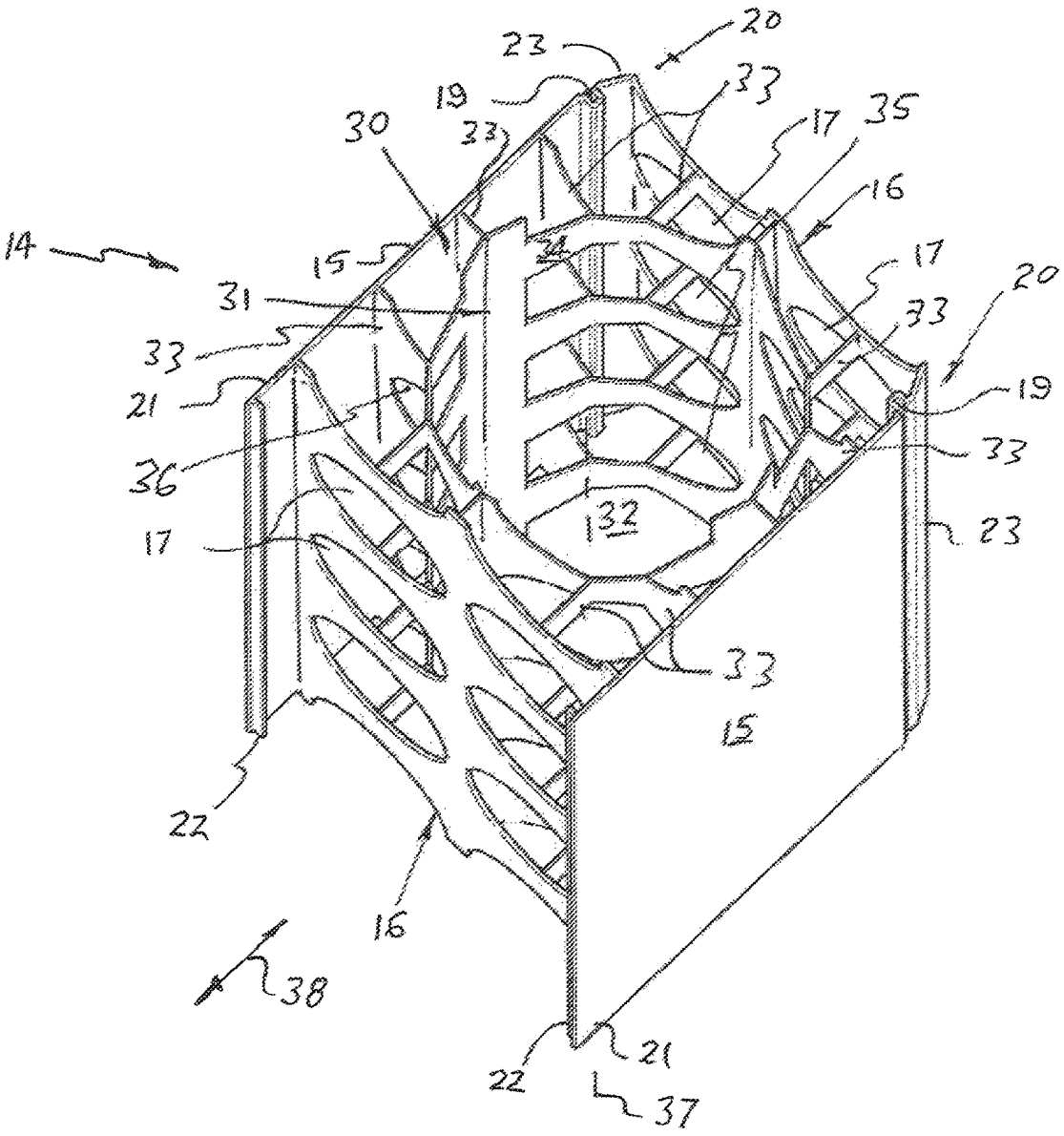
FIG. 3 is a schematic isometric view of the element of FIG. 2.
Figure 4:
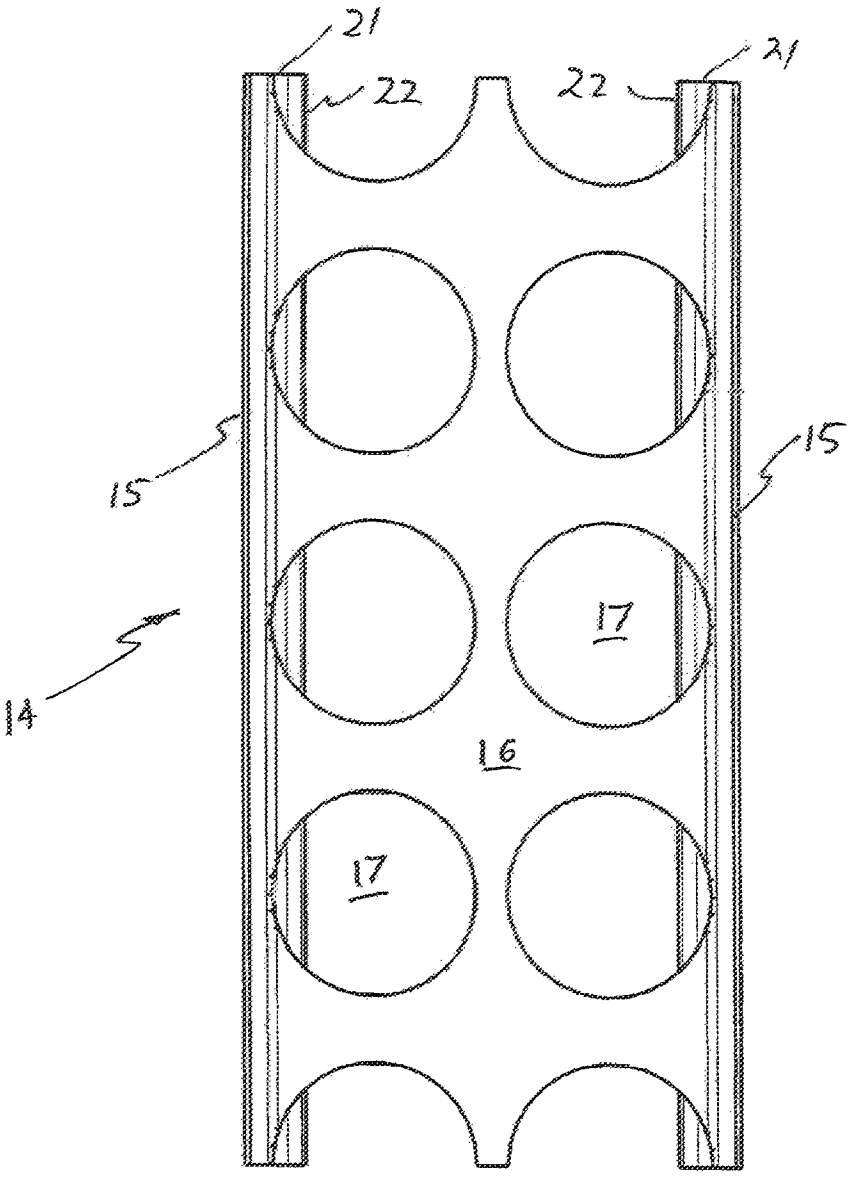
FIG. 4 is a schematic side elevation of the element of FIG. 2.

Each of the side walls 15 is provided with a longitudinally extending groove 19 adjacent a longitudinal edge 20 of the respective side wall 15. Extending from each side wall 15 is a longitudinally extending flange 21, the flanges 21 being generally parallel and coextensive with respect to the grooves 19. Each flange 21 includes a longitudinally extending lip 22 which is received within the grooves 19 of the next adjacent element 14. Extending to each groove 19 is a ramp surface 23. The surfaces 23, as best seen in FIG. 2, are located adjacent the end transverse web 16 and diverge from adjacent the end web 16 to the adjacent groove 19.

When assembling the elements 14, adjacent elements 14 are moved in a transverse direction (horizontal) 38 relative to each other, with the flanges 21 being resiliently urged apart by means of the surfaces 23. When the lips 22 are aligned with the grooves 19 they snap engage within the grooves 19 to retain adjacent elements 14 together. Accordingly, the flanges 21 extend between adjacent elements 14.

The adjacent elements 14 may also be engaged by firstly engaging one lip 22 in its associated groove 19, with the transverse movement being a pivoting movement.

When constructing the wall portion 10 an installer would connect the elements 14 by transverse movement between adjacent elements 14. Thereafter, the elements 14 may be filed with the concrete 18.

In an alternative preferred form, like elements 14 may be coupled by longitudinal relative sliding movement. That is each lip 22 would be engaged with its associated groove 19, and the elements 14 moved longitudinally relative to each other so as to be coupled.

The wall portion 10 may be load bearing or non-load bearing as required. Still further, if so required, reinforcing elements may pass longitudinally through the elements 14.

The walls 15 and transverse webs 16 enclose a longitudinal extending space 30. Located in the space 30 is a longitudinally extending tube 31 that encloses a longitudinally extending space 32 that is part of the space 30.

The concrete 18 occupies the space 30, and therefore occupies the space 32.

In this embodiment the tube 31 is spaced from the walls 15 and webs 16, and is connected to the walls 15 and transverse webs 16 by a plurality of flanges 33.

Preferably the tube 31 is located generally centrally of the space 30.

In this embodiment, tube 31 is formed of a plurality of generally planar longitudinally extending sections 34 arranged about the central longitudinal axis 37.

The tube 31 can be of any desired cross-section, such as circular, square, rectangular or oval. However a circular transverse cross-section provides unexpected advantages in respect of strength of the element 14. When the element 14 is extruded, that is of an integral formation of plastics material, the tube 31 and flanges 33 are integrally formed with the walls 15 and webs 16.

In the above described preferred embodiment, the element 14 is of a unitary construction, such as an extrusion. However, in an alternative construction, the element 14 may be an assembly. As one particular example, the walls 15 and webs 16 may be an extrusion, and the tube 31 a second extrusion. The flanges 33 would be attached to the walls 15 and webs 16, and tube 31 by sliding and/or snap engagement. The engagement would ensure the joins were waterproof.

Preferably, the tube has apertures 35 and the flanges 33 with apertures 36 so that concrete 18 can fill the spaces 30 and 32.

Figures 5, 6:
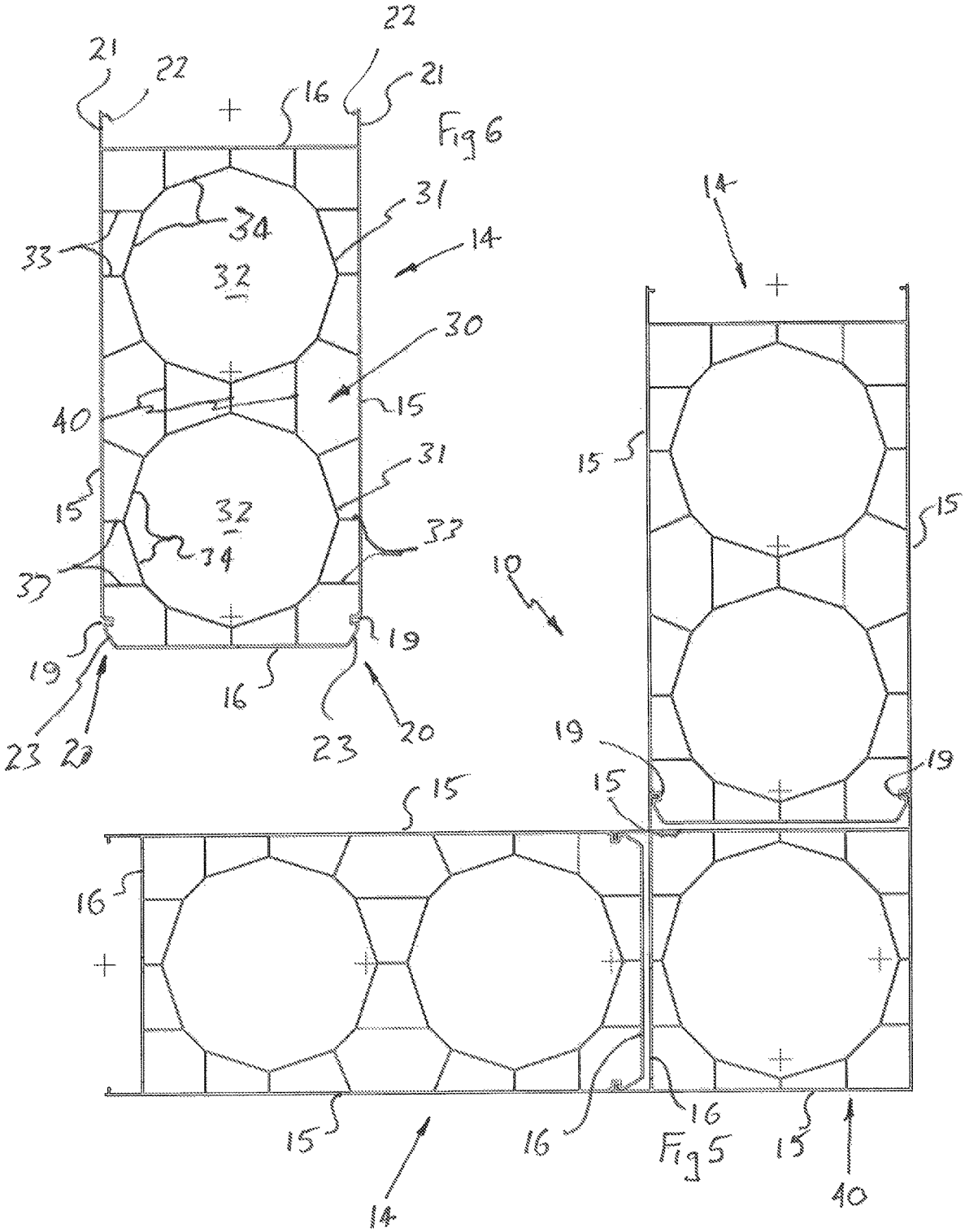
FIG. 5 is a schematic top plan view of a plurality of building elements forming a wall.
FIG. 6 is a schematic top plan view of one of the elements of FIG. 5.

In the embodiment of FIGS. 5 and 6, there are two tubes 31. In addition to the flanges 33, there are additional flanges 40 that extend between the two adjacent tubes 31. The tubes 31 are transversely spaced, and are preferably co-extensive and parallel, and both extend longitudinally of the element 14.

The above embodiment has been designed to incorporate up to 225 mm+/−25 mm slump with up to 30 mm aggregate size to achieve better utilisation of natural rock aggregates, and more importantly, high slump of concrete use to avoid any concerns of air voids formation, particularly when a wall includes two layers of horizontal steel bars use in shear walls (i.e. earthquake resisting walls). These types of walls carry high stresses hence no air voids can be tolerated by the structural design engineer.

The above embodiment significantly reduces damage to the walls 15 and webs 16 that has been normally experienced with formworks that solely rely on equivalent webs 16 of previous building elements holding the outer faces together when receiving concrete infill. The above embodiment offers a significantly more robust formwork which does not rely on a single web 16 holding each formwork face together.

In the above embodiment the tube 31 going into tension supports the outer flat faces by the walls 15 between the tube 31 and outer flat faces. This three-dimensional formwork design of the above embodiment is able to carry significantly higher concrete pressure than what is normally achieved with resistance to pressure carried by webs 16 only joining each flat formwork face to each other. Therefore, the tube 31 assists the flat faces compositely handling the concrete pressure. The presence of the tube 31 further makes the whole assembly much more robust, hence avoids the majority of damages that normally occur in conventional designs.

Building elements made out of polymer provide high tensile capacity. Concrete is a brittle material by nature which virtually has no tensile capacity hence the reason conventional concrete receives reinforcing steel bars to provide tensile capacity to the concrete. The concrete infill and polymer building element work in a composite action which eliminates or reduces the brittle nature of concrete hence the composite action achieves a ductile behaviour. The capacity of composite action is based on the contact area in shear between the concrete and the polymer building element. The present embodiment significantly increases shear contact area in three dimensions in comparison to previous building elements thus providing significant tensile capacity to concrete. This capability, together with the tube and outer faces encapsulating the concrete, prevents concrete spalling by confining the concrete when the concrete is subject to forces such as earthquake, cyclone, blast or impact loadings.

The worldwide engineering codes provide load combinations for structural design. The load combinations such as fire/earthquake or fire/cyclone or fire/blast loading are not considered together due to rare load combinations occurring at the same time. For example fire could only occur after the earthquake impact which only occurs within 30 seconds maximum. The external polymer face of the building element can burn in the case of a building fire hence engineers cannot utilise the composite action for structural design purposes. The present embodiment provides adequate concrete infill between tube and outer face of polymer which protect the tube in the case of fire. Accordingly, engineers are able to use the composite action for the elimination or reduction of reinforcing steel bars which are normally required to increase the tensile capacity of concrete.

Engineers are therefore able to use the tube 31 as complementary to or as a replacement for steel bars used in structures such as basement walls to which earth pressure is applied.

Accordingly, the above embodiments are a more robust building element, and will allow at least 3 m intervals (height) of concrete pouring at each pour even with high slump concrete.

The invention claimed is:

1. A hollow elongated building element into which concrete is to be poured, the hollow elongated building element including:

a pair of longitudinally extending spaced side walls extending in a longitudinal direction which are generally parallel;

spaced transverse webs joining the longitudinally extending spaced side walls surrounding a longitudinally extending space extending in the longitudinal direction; and at least one longitudinally extending tube extending in the longitudinal direction, located in the longitudinally extending space, the longitudinally extending tube is spaced from the longitudinally extending spaced side walls and connected to the longitudinally extending spaced side walls and/or spaced transverse webs by a plurality of connecting flanges, wherein the spaced transverse webs include apertures through which concrete passes in-use, and the at least one longitudinally extending tube includes a cylindrical surface having apertures through which concrete passes in-use into the at least one longitudinally extending tube.

2. The hollow elongated building element of claim 1, wherein the longitudinally extending spaced side walls are generally co-extensive and generally parallel.

3. The hollow elongated building element of claim 1, wherein the connecting flanges connect the at least one longitudinally extending tube to the longitudinally extending spaced side walls and the spaced transverse webs.

4. The hollow elongated building element of claim 1, wherein each longitudinally extending tube is of a circular transverse cross-section.

5. The hollow elongated building element of claim 1, wherein there is only one longitudinally extending tube.

6. The hollow elongated building element of claim 1, wherein said longitudinally extending tube is a first longitudinally extending tube, and said hollow elongated building element includes a second longitudinally extending tube, the second longitudinally extending tube also being located in said longitudinally extending space, and being displaced from the first longitudinally extending tube.

7. The hollow elongated building element of claim 6, further including flanges joining the first and second longitudinally extending tubes.

8. The hollow elongated building element of claim 1, wherein each longitudinally extending spaced side wall has a longitudinally extending groove and a longitudinally extending joining flange extending from the longitudinally extending spaced side wall, with each longitudinally extending flange and longitudinally extending groove being positioned and configured to engage a respective longitudinally extending groove or longitudinally extending flange of a second hollow elongated building element to secure adjacent elements together by engagement of the longitudinally extending flange within the respective adjacent longitudinally extending groove by movement of the longitudinally extending groove and the longitudinally extending flange relative to each other, with each longitudinally extending groove being formed in a respective one of the longitudinally extending spaced side walls and each longitudinally extending flange extending from a respective longitudinally extending spaced side wall so that the second hollow elongated building element is located between the longitudinally extending flanges to provide for engagement of the longitudinally extending flanges and longitudinally extending groove, and the longitudinally extending spaced side walls and the spaced transverse webs surround the longitudinally extending space that receives the concrete, and the hollow elongated building element further includes at least one of the longitudinally extending grooves and the respective longitudinally extending flanges are configured to snap engage to connect the adjacent elements.

9. The hollow elongated building element of claim 8, wherein the movement is generally transverse of the hollow elongated building element.

10. The hollow elongated building element of claim 8, wherein the movement is longitudinal sliding relative movement between the hollow elongated building element and the second hollow elongated building element.

11. The hollow elongated building element of claim 1, wherein the hollow elongated building element is of a unitary construction.

12. The hollow elongated building element of claim 11, wherein the hollow elongated building element is an extrusion.

13. The hollow elongated building element of claim 1, wherein the hollow elongated building element is an assembly.

* * * * *